United States Patent [19]

Looney

[11] Patent Number: 4,712,786

[45] Date of Patent: Dec. 15, 1987

[54] COPY SHEET OFFSETTING DEVICE

[75] Inventor: John H. Looney, Fairport, N.Y.

[73] Assignee: Xerox Corporation, Stamford, Conn.

[21] Appl. No.: 810,453

[22] Filed: Dec. 18, 1985

[51] Int. Cl.[4] ..... B65H 31/00

[52] U.S. Cl. ..... 271/207; 271/251; 271/286; 271/188; 355/14 SH

[58] Field of Search ..... 271/285, 286, 250, 251, 271/252, 240, 188, 239, 207, 184; 355/14 SH, 3 SH; 414/62, 63, 59

[56] References Cited

U.S. PATENT DOCUMENTS

| | | | |
|---|---|---|---|
| 3,915,449 | 10/1975 | Johnson | 271/251 X |
| 4,017,066 | 4/1977 | Lasher | 271/251 X |
| 4,058,359 | 11/1977 | Urselmann | 271/250 X |
| 4,162,786 | 7/1979 | Bullock | 271/251 X |
| 4,188,205 | 2/1980 | Gusfafson et al. | 271/314 |
| 4,236,856 | 12/1980 | Moh et al. | 414/54 |
| 4,335,954 | 6/1982 | Phelps | 271/251 X |
| 4,431,177 | 2/1984 | Beery | 271/250 X |
| 4,486,014 | 12/1984 | Enoguchi | 271/251 X |
| 4,487,407 | 12/1984 | Baldwin | 271/252 X |

FOREIGN PATENT DOCUMENTS

| | | | |
|---|---|---|---|
| 30334 | 3/1978 | Japan | 271/286 |
| 1594488 | 7/1981 | United Kingdom | 271/251 |

OTHER PUBLICATIONS

IBM Technical Disclosure Bulletin, vol. 22, No. 6, pp. 2496–2497, "Paper Feed Mechanism", J. S. Heath.

*Primary Examiner*—Richard A. Schacher

*Attorney, Agent, or Firm*—William A. Henry, II

[57] ABSTRACT

A printing apparatus including a sorter and an offsetting device. The offsetting device is positioned within the printer and is adapted to translate sheets in route to the sorter alternately front and rearward such that copy sheets are offset before they are driven into the sorter with subsequent copy sheet sets being offset from each other within bins of the sorter.

15 Claims, 5 Drawing Figures

159
135
109
106
B
C
B
102
105
168
100
152
103
104
101
161
108
C
150
135
180
158
125
120
127
128

160
164
165
163
162
161
180

158
157
180
138
168
160
156
161
102
105
150
152
135
155

COPY SHEET OFFSETTING DEVICE

This invention relates to a printer apparatus, and more particularly to an offsetting device for use with such a printing apparatus to provide copy sheet set distinction in a portion of the printer, such as, a catch tray, sorter or finisher.

The need has been recognized for controlling the position of the rear edge of copy sheets in developing output devices as well as the benefits of doing so. Generally, they are:

(a) To adapt a single finisher design (which requires front edge registration) to an array of processors having rear, center, and front registration.

(b) To provide for lateral offset of sets in the catch tray for set distinction.

(c) To preserve set distinction in compact sorters (those having confined bin pitch, such that they cannot be unloaded one set at a time). Compact sorters are easy to unload because sets can be unloaded in groups, however, if offsetting of the sets is not used, maintaining set distinction while removing the sets is difficult at best.

(d) To bring smaller sheets to the front for visual inspection and unloading.

(e) To enable, in concert with an automatic document feeder (ADF), simpler sorters (e.g., 10 bin vs. 20 bin) by putting 2 sets in each bin (two passes through the ADF).

(f) To facilitate distinction of copies being run in a job interrupt mode.

(g) To enable (in concert with an ADF) set copying without the use of a sorter, since successive ADF passes can be distinguished by set offset.

All of the above benefits except (c) can be achieved by shifting the output device itself, e.g., an offsetting catch tray. However, (c) requires sheet-by-sheet offsetting.

Therefore, in accordance with the present invention, a printing apparatus is disclosed for obtaining the benefits of (a)-(g) that is adapted for printing copies of page image information onto copy sheets and feeding the copy sheets into a sorter with the sheets being offset in the sorter in sets. An improvement is included that comprises an offsetting device that is positioned within the printer and adapted to translate sheets within the printer while they are in route to the sorter alternately front and rearward such that offset sets of copy sheets are attained in the sorter.

For a better understanding of the present invention, reference may be had to the accompanying drawings wherein the same reference numerals have been applied to like parts and wherein.

Figure 1:
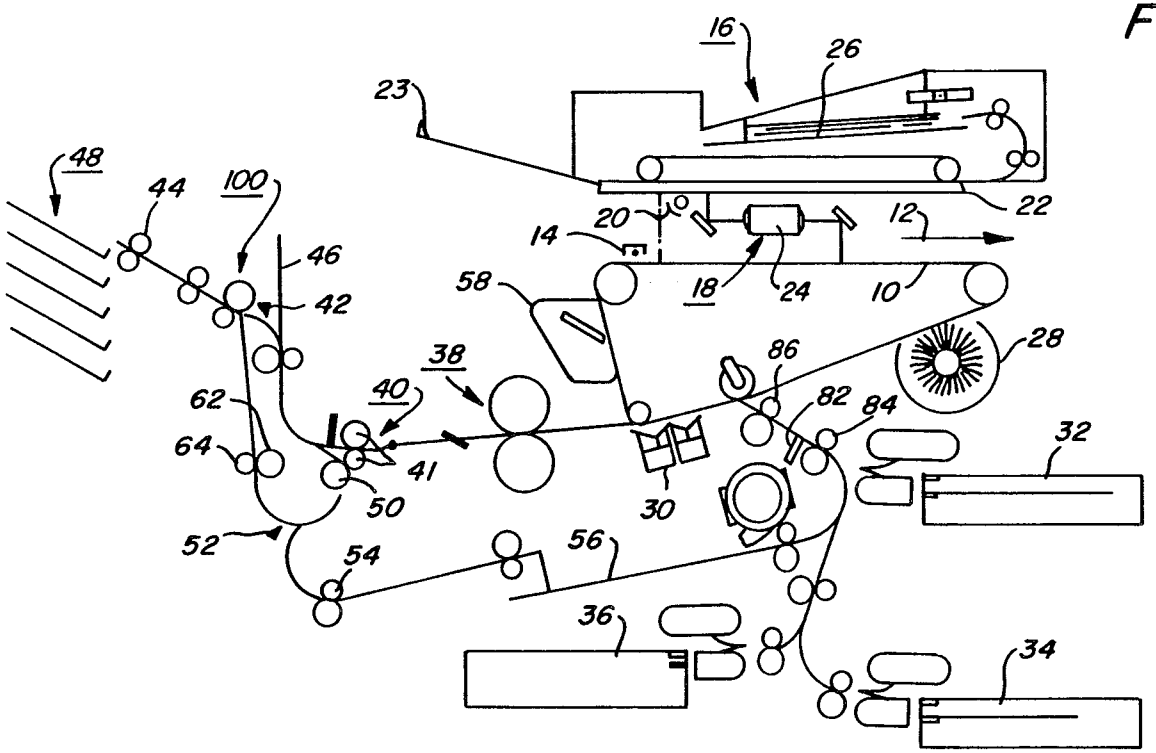
FIG. 1 is a schematic elevational view of a reproduction machine that employs the offsetting device of the present invention.
Figure 2:
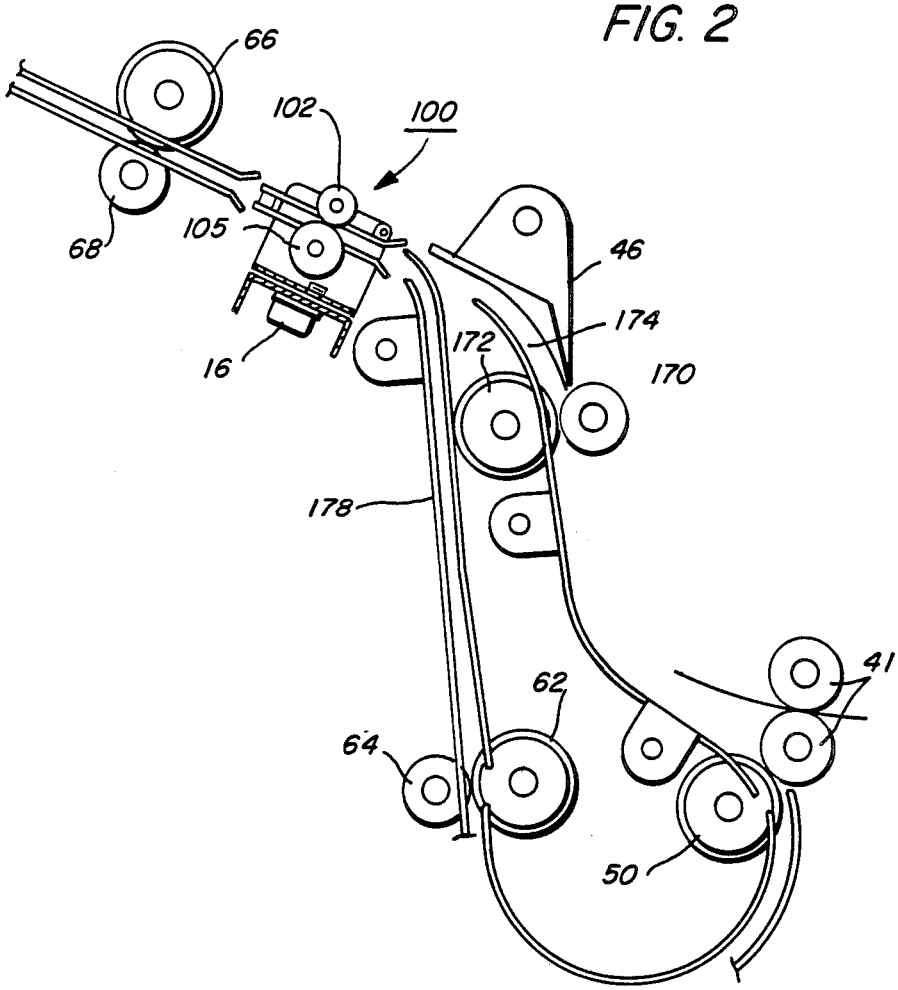
FIG. 2 is an exploded elevational view of a part of the paper path of the reproduction machine of FIG. 1 and includes positional relationship of the offsetting device of the present invention within the machine paper path.

With reference to FIGS. 1 and 2, there is shown an electrophotographic printing or reproduction machine employing a belt 10 having a photoconductive surface. Belt 10 moves in the direction of arrow 12 to advance successive portions of the photoconductive surface through various processing stations, starting with a charging station including a corona generating device 14. The corona generating device charges the photoconductive surface to a relatively high substantially uniform potential.

The charged portion of the photoconductive surface is then advanced through an imaging station. At the imaging station, an automatic document feeder (ADF) 16 positions an original document face down over exposure system 18. The exposure system 18 includes lamp 20 illuminating the document positioned on transparent platen 22. The light rays reflected from the document are transmitted through lens 24. Lens 24 focuses the light image of the original document onto the charged portion of the photoconductive surface of belt 10 to selectively dissipate the charge. This records an electrostatic latent image on the photoconductive surface corresponding to the information areas contained within the original document.

ADF 16 sequentially feeds documents from a holding tray 26, in seriatim, to platen 22. The document handling unit 16 drives the documents off platen 22 after imaging to a position where they are supported on tray 23. Thereafter, belt 10 advances the electrostatic latent image of each document recorded on the photoconductive surface to a development station.

At the development station a magnetic brush developer roller 28 advances a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to the transfer station. At the transfer station a copy sheet is moved into contact with the toner powder image. The transfer station includes a corona generating device 30 which sprays ions onto the backside of the copy sheet. This attracts the tone powder image from the photoconductive surface of belt 10 to the sheet.

The copy sheets are fed from a selected one of trays 32, 34 or 36 to the transfer station. After transfer, sheets are advanced to a fusing station. The fusing station includes a fuser assembly for permanently affixing the transferred powder image to the copy sheet. Preferably, fuser assembly 38 includes a heated fuser roller and backup roller with the sheet passing between fuser roller and backup roller.

After fusing, conveyor 40 transports the sheets to gate 42 which functions as an inverter selector. Depending upon the position of gate 42, the copy sheets will either be deflected into and through offsetting device 100 to sorter 48 through drive rolls 44 or driven up the transport 46. If a sheet is driven onto transport 46, the trailing edge of the sheet upon passing drive rolls 41, drops into engagement with drive rollers 50. At this point, the sheet will be driven to gate 52. Decision gate 52 deflects the sheet directly into offsetting device 100 and sorter 48 in an inverted mode or deflects the sheets into a duplex inverter roll transport 54 to duplex tray 56. Duplex tray 56 provides intermediate or buffer storage for those sheets which have been printed on one side for printing on the opposite side. In order to complete duplex copying, the previously simplexed sheets in tray 56 are fed in seriatim back to the transfer station for transfer of the toner powder image to the opposed side of the sheet and then transported through offsetting device 100 to sorter 48. Invariably after the copy sheet is separated from the photoconductive surface of belt 10, some residual particles remain adhering to belt 10. These residual particles are removed from the photoconductive surface thereof at a cleaning station 58.

It is believed that the above description is sufficient for one to understand the general operation of the printing machine into which the present invention is incorporated. Now with particular reference to FIGS. 3A–3C, a device 100 is disclosed for offsetting individual sheets as they pass through while the sheets are still within the printer and before they reach sorter 48. The advantages of such an offsetting device are numerous. For example, this device in cooperation with a compact sorter assures easy unloading of the sorter while maintaining excellent set distinction. Also, the device provides the offsetting function for many other devices, e.g., finisher, catch tray. In addition, the device provides for better operability by bringing sets to the front for easy unloading and by furnishing job interrupt distinction.

Figure 3A:
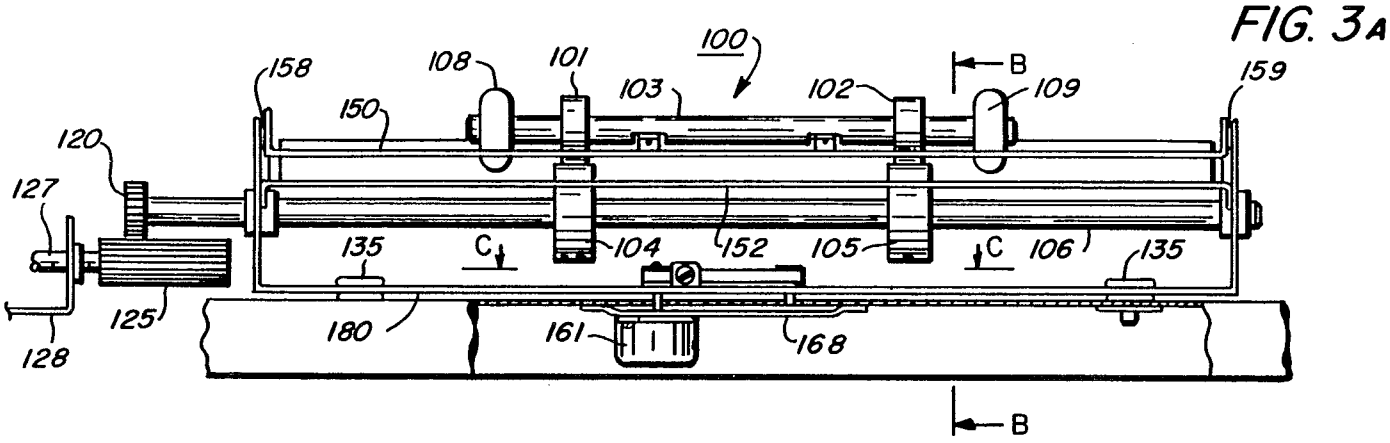
FIG. 3A is an exploded partial front elevational view of the present offsetting device.
Figure 3C:
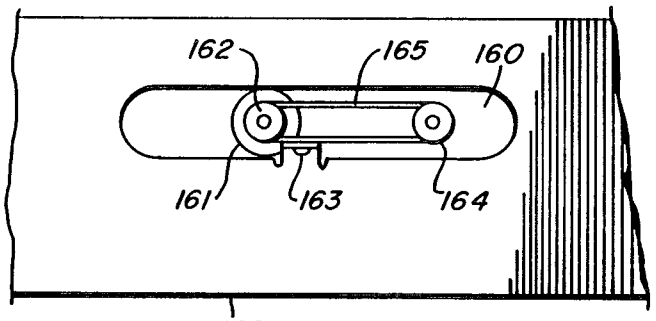
FIG. 3C is an exploded partial plan view of the offsetting device shown in FIG. 3A and taken along line C—C.
Figure 3B:
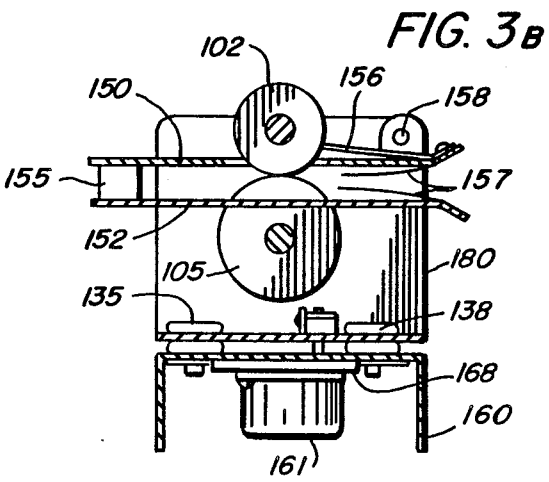
FIG. 3B is an exploded partial side view of the offsetting device shown in FIG. 3 an taken along line B—B.

As seen in FIGS. 3A and 3B, angled bracket 128 that is mounted on the machine frame (not shown) supports a shaft 127 on which is mounted a drive gear 125. A driven gear 120 is drivingly connected to shaft 106 so that rotation of drive gear 125 rotates shaft 106 through driven gear 120. A pair of feed rolls 104 and 105 are mounted on shaft 106 and adapted for driving engagement with ball bearing idler rolls 101 and 102. The idler rolls as well as a pair of Delrin corrugator rolls 108 and 109 are mounted for rotation on shaft 103. Shaft 106 is supported for rotation within U-shaped channel member 180. Channel member 180 has keyhole slots in its horizontal surface into which plastic guide buttons 135, and 138 are placed. Drive gear 125 is unusually wide with respect to the width of the teeth on driven gear 120 and in conjunction with the keyhole slots in channel member 180 and the guide buttons allow the channel member to be translated orthogonal to the direction of copy sheet travel or movement in order to provide a means for moving a copy sheet a predetermined distance transverse to the direction of sheet travel during the time the copy sheet is passing through the channel member area.

In further reference to FIG. 3A, a lower stationary guide member 152 is supported by upstanding portions of channel member 180 and adapted to support copy sheets passing through the offsetting device 100. An upper moveable guide member 150 helps to guide copy sheets through the area of the offsetting device and has magnets 155 connected thereto that mate with the upstanding portions of channel member 180 in order to allow guide 150 to be easily pivoted at 158 and 159 and moved away from guide member 152 for ease of removal of jammed copy sheets or for service of the device. A stepping motor 161 of the type made by Molon Motor & Coil Corp., 3737 Industrial Avenue, Rolling Meadows, Ill. 60008 is supported by plate 168 that is connected to mounting channel 160.

As seen in FIG. 3C, actuation of stepping motor 161 for a predetermined number of steps rotates drive wheel 162 that is drivingly connected to idler wheel 164 through timing belt 165. As the timing belt is rotated by the stepping motor from left to right as viewed in FIG. 3, channel member 180 is moved to the right (for example, one inch) since finger member 163 is attached to both the timing belt and channel member 180. It should be understood that counterclockwise rotation of the stepping motor moves the channel member 180 to the right side of FIG. 3A. Turning to FIG. 3B, it is seen that idler roll 102 is loaded into engagement with drive roll 105 through leaf spring 156 and that copy sheets are positioned in the nip formed between rolls 102 and 105 by the use of slippery, low friction surfaced nip-entry guide fingers 157.

In operation, copy sheets requiring offsetting and coming through the thru-path 174 are engaged by a nip formed between rolls 170 and 172. Rollers 170 and 172 are adapted for disengagement or separation and are opened as soon as the sheet is in the offsetting device and the offsetting device then moves the copy sheets either left or right in order to place a predetermined offset in each sheet before it reaches the sorter, i.e., while the copy sheet is still within the printer. For example, with a requirement of 5 sets of a 10 page document using the ADF heretofore described, the document pages would be circulated onto the platen 1 at a time, with 5 copies of each page being made and sent to separate bins in sorter 48. Each sheet as it travels through the offsetting device, would be offset laterally by approximately one inch alternately front and back or rearward before it reaches the sorter. The result would be 5 sets of the 10 page document with each set offset from the other by approximately one inch for ease of operator removal. This same procedure is used for any number of sets up to the bin capacity and number of bins in the sorter. Since the offsetting is accomplished with use of a stepper motor, the offset distinction within the bins could be as large or small as one desires. For example, the offset could be one-half inch if the operator desired such. In other words, the offset could be preset when the machine or printer is being manufactured or it could be software controlled from the console of the printer. The operation of offsetting device 100 is the same whether copy sheets are simplexed (imaged on open side) or duplexed (imaged on both sides), the only difference is that with the duplex or invert requirement copy sheets enter offsetting device 100 by way of nip 62, 64 and invert channel 178. For finishing purposes, the offsetting device is adapted to align copy sheets along a selected edge.

The offsetter mechanism of the present invention could be used with a recirculating document handler where pages of a document set are circulated to the imaging for an image of each page to be made singularly and copies forwarded to a catch tray with one circulation of the document pages equaling one complete copy set in the catch tray. The offsetter mechanism would be used to offset the next copy set before the copies reach the catch tray so that set two of the document will be offset from set one when resting within the catch tray. The offsetter could also be used when documents are placed upon an imaging station by hand.

It should now be apparent that a printing apparatus has been disclosed that includes an offsetting device which is driven by a stepping motor to provide specific front or rear offsetting in a sorter or catch tray or precise front edge positioning for finishing and thereby minimizes paper handling and relative motion of paper in relation to transport members.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed is:

1. In a printing apparatus having a page image transfer area and an output area and adapted for printing page image information onto copy sheets and feeding the copy sheets out of the output area into a sorter with the copy sheets being offset in the sorter in sets, the improvement, comprising:

offsetter means positioned within the printer between said page image transfer area and said output area and adapted to translate copy sheets in route to the sorter alternately front and rearward during the time each copy sheet is within said offsetter means such that offset sets of copy sheets are attained in the sorter.

2. The apparatus of claim 1, wherein said offsetter means includes a channel member which is adapted for reversible translation orthogonal to the direction of movement of the copy sheets.

3. The apparatus of claim 2, wherein said channel member includes a horizontal base portion and upstanding side portions, said horizontal base portion having slots therein and wherein guide means are included within said slots that are adapted to guide said channel member during translation thereof.

4. The apparatus of claim 3, including means for moving said channel member.

5. The apparatus of claim 4, wherein said means for moving said channel member comprises a stepper motor and a timing belt.

6. The apparatus of claim 5, wherein said stepping motor and timing belt are drivingly connected to said channel member such that actuation of said stepping motor causes movement of said channel member.

7. The apparatus of claim 6, wherein said upstanding side portions of said channel member support a rotatable shaft and a set of drive rolls.

8. The apparatus of claim 7, including a set of idler rolls spring loaded against said set of drive rolls to form a nip for driving copy sheets therethrough.

9. The apparatus of claim 8, including corrugation means positioned on opposite sides of said set of idler rolls and adapted to corrugate a sheet as it passes through the nips formed between said set of drive rolls and said set of idler rolls.

10. The apparatus of claim 9, including guide means for guiding sheets into and out of said offsetter means, said guide means having a portion thereof adapted to be pivoted in order to clear copy sheet jams and wherein said guide means includes magnets for holding said guide means in a predetermined position until pivoting of said portion of said guide means is required.

11. The apparatus of claim 7, wherein said rotatable shaft is drivingly connected to a driven gear, said driven gear being positioned in engagement with a drive gear to be driven thereby, said drive gear having teeth of sufficient width that said channel member can be translated without disengagement of said driven gear with said drive gear.

12. The apparatus of claim 10, wherein said guide means includes low friction nip entry guide fingers that guide copy sheet into the nip formed between said set of drive rolls.

13. In a printing apparatus having a page image transfer area and an output area and adapted for printing page image information onto copy sheets and feeding the copy sheets into an output device, the improvement for positioning the copy sheets before they reach the output device, comprising:

offsetter means positioned within the printer between said page image transfer area and said output area and adapted to move the copy sheets alternately orthogonal to their direction of travel during the time each sheet is within said offsetter means such that they will be in a predetermined alignment once they reach the output device.

14. The printing apparatus of claim 13, wherein said offsetter means includes at least two sets of rollers and wherein said offsetter means and said at least two sets of rollers are moved laterally as a unit in order to shift each of said copy sheets so that each sheet will be directed toward a registration edge of the output device.

15. In a printing apparatus adapted for printing page image information onto copy sheets and feeding the copy sheets into a finisher with the copy sheets being aligned against a common edge of the finisher in sets for stapling, stitching or binding, the improvement, comprising:

offsetter means positioned within the printer and adapted to translate in transit each of the copy sheets in route to the finisher in a direction transverse to the direction in which they are traveling such that sets of copy sheets are aligned against said common edge of the finisher.

* * * * *